United States Patent [19]

Szkudlarek

[11] 4,453,456

[45] Jun. 12, 1984

[54] SUPPLEMENTAL VENTILATING DEVICE FOR AN AIR CONDITIONING WINDOW UNIT

[76] Inventor: Warren E. Szkudlarek, 2937 Logan Blvd., Chicago, Ill. 60647

[21] Appl. No.: 412,891

[22] Filed: Aug. 30, 1982

[51] Int. Cl.[3] ..... E06 7/02; A47H 1/00; E06B 3/32

[52] U.S. Cl. ..... 98/88 S; 98/94 AC; 160/91; 160/89

[58] Field of Search ..... 98/94 AC, 99 A, 100; 165/59, 122; 62/262; 160/87, 84, 89, 90, 91, 222, 223

[56] References Cited

U.S. PATENT DOCUMENTS

| | | | |
|---|---|---|---|
| 450,256 | 4/1891 | Sanguinetti | 160/89 |
| 2,414,592 | 1/1947 | Garlinski | 160/91 |
| 3,111,076 | 11/1963 | Martin, Jr. et al. | 62/262 X |
| 3,587,441 | 6/1971 | Woods | 98/94 |
| 3,911,803 | 10/1975 | Kong et al. | 62/262 X |

*Primary Examiner*—William E. Wayner

[57] ABSTRACT

A supplemental ventilating device for a window-mounted air conditioning unit comprising a screen in a frame mounted above or alongside an air conditioning window unit. At least one door covers the screen to control input of outside air providing quiet, economical ventilation without running the air conditioning unit fan motor. The frame, screen and door are extendible and retractible to fit different width windows. In one embodiment, the device is located between the air conditioning unit casing and a window sash. In another embodiment, additional frames, screens and doors are located between the sides of the casing and the window jambs.

13 Claims, 16 Drawing Figures

Fig. 13
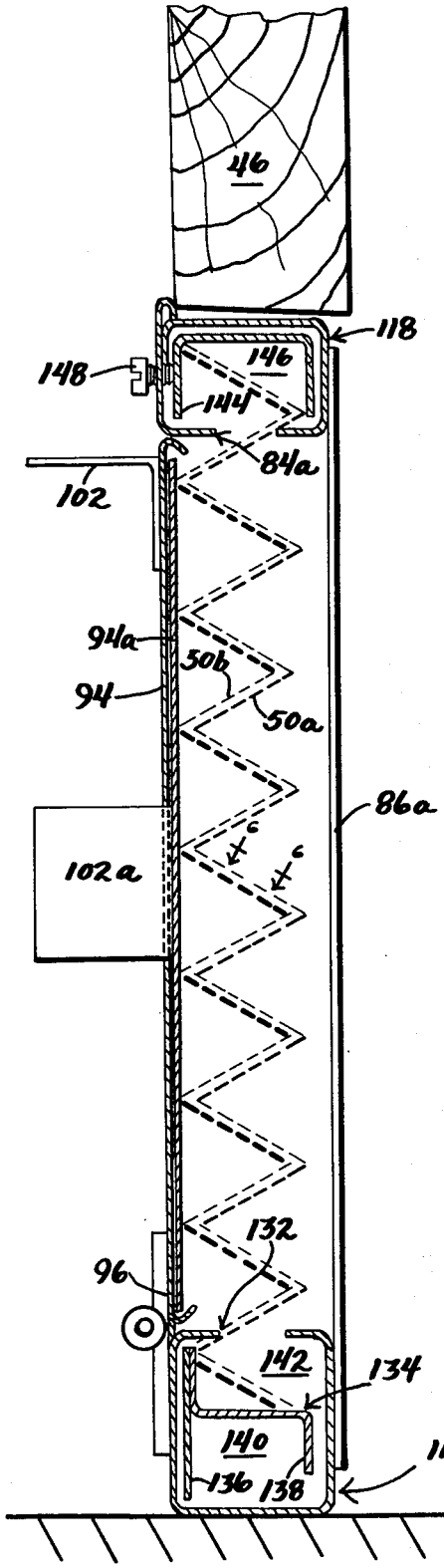
Fig. 11
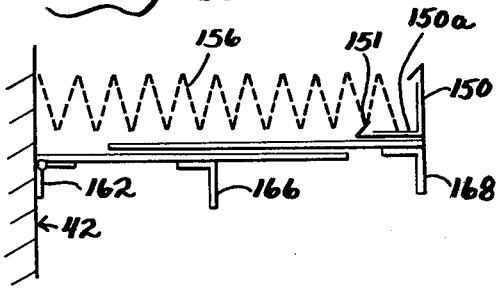
Fig. 12
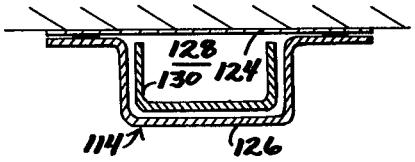
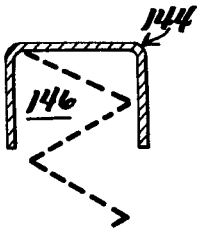
Fig. 16
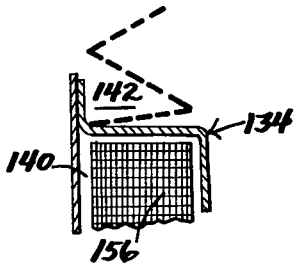
Fig. 15
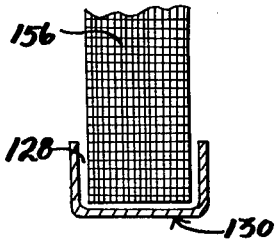
Fig. 14

SUPPLEMENTAL VENTILATING DEVICE FOR AN AIR CONDITIONING WINDOW UNIT

BACKGROUND OF THE INVENTION

This invention belongs to the field of air conditioners, and particularly to window-mounted units.

Typically these units have a casing supported on a window sill and a window sash is sealed against the top of the casing. Horizontally extendible filler members are provided on the sides of the casing and are sealed against the window jambs.

In a conventional installation, the window is sealed in such a way that it cannot readily be opened. No ventilating air can enter unless the air conditioning unit is in cooling or fan mode. In either mode, the fan is on, uses electrical energy, and makes noise which may be objectionable and interfere with sleep, conversation, or radio or TV programs. There is a need for a quiet means to ventilate a room equipped with such a window type air conditioning unit without running the fan motor, especially during mild or cold weather when it is unnecessary to run the unit in cooling mode.

Summary of the Invention

Therefore, a principal object of the invention is to provide a supplemental ventilating device for an air conditioning window unit enabling outside air to bypass the unit quietly without operating the fan motor.

Another object is to provide such a supplemental ventilating device which can be mounted easily on an existing air conditioning unit already installed in a window.

Another object is to provide a ventilating device with a screen in a frame adapted to fit between an air conditioning unit casing and a window sash, and a door regulating the flow of ventilating air through the screen.

Another object is to provide such a ventilating device with side screens in frames fitted between the sides of the air conditioning unit casing and the window jambs, and separate doors for selectively controlling flow of ventilating air through the side screens.

Another object is to provide such a ventilating device with extendible frames, screens and doors to fit windows of different widths.

To accomplish the above and related objects, this invention may be embodied in the form illustrated in the accompanying drawings, attention being called to the fact, however, that the drawings are illustrative only and that changes may be made in the specific construction illustrated and described within the scope of the appended claims.

Brief Description of the Drawings

FIG. 11 is an enlarged fragmentary, horizontal cross-sectional view of FIG. 9 taken along line 11—11;

FIG. 12 is an enlarged vertical cross-sectional view of FIG. 9 or 10 taken along line 12—12;

FIG. 13 is an enlarged cross-sectional view of FIG. 9 taken along line 13—13; and FIGS. 14, 15 and 16 are fragmentary enlarged vertical cross-sectional views of FIG. 10 taken along lines 14—14, 15—15 and 16—16, respectively.

Like parts are referred to by like reference characters.

Detailed Description of the Preferred Embodiments

Figure 1:
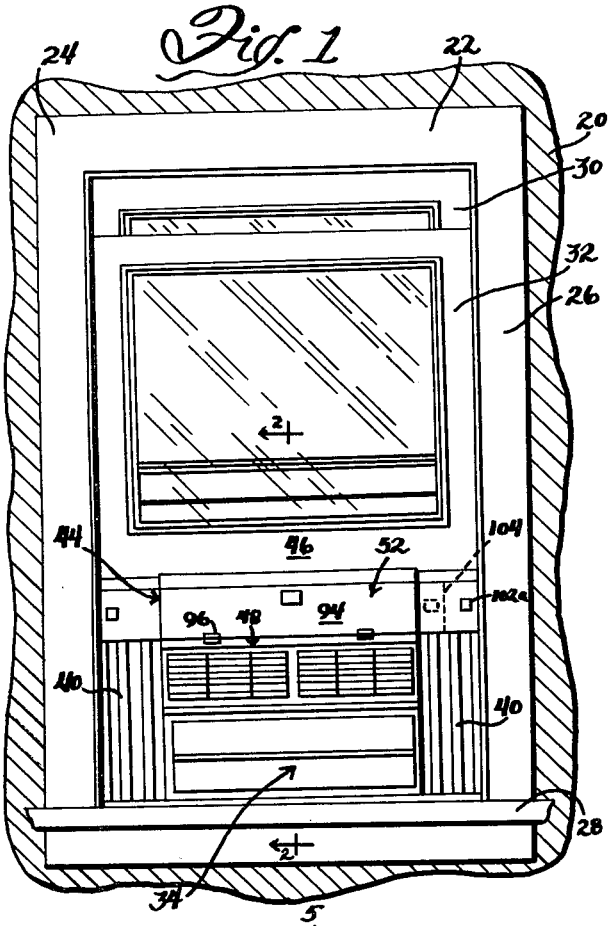
FIG. 1 is an elevational view taken from the inside of a room with an air conditioning unit installed in a window and illustrating one embodiment of a supplemental ventilating device according to the present invention.
Figure 2:
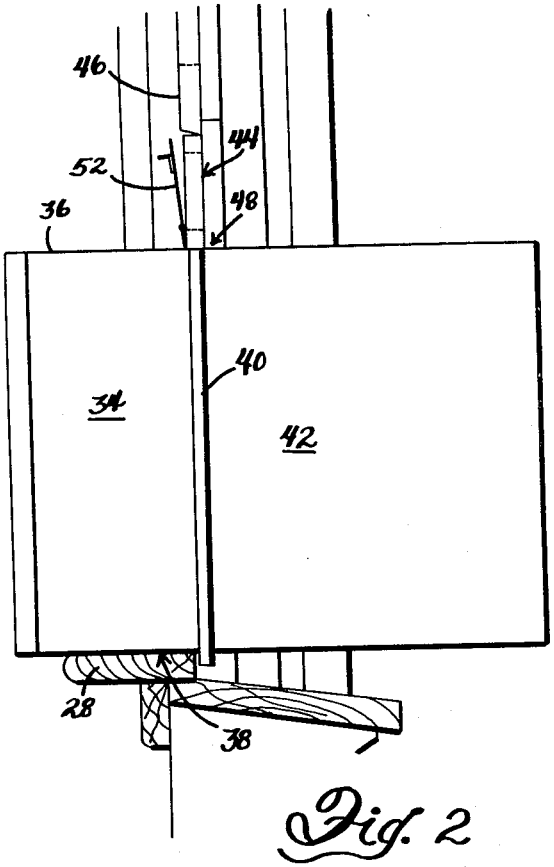
FIG. 2 is a side elevational view, partly in section, taken along line 2—2 of FIG. 1.

Referring now to the drawings in greater detail, FIGS. 1 through 5 illustrate a compact, portable embodiment of the invention which is readily adaptable to an existing air conditioning window unit installation. FIGS. 7 through 16 illustrate a larger, somewhat more complex embodiment which may be supplied with an air conditioning unit as it comes from the manufacturer although, it, too, may be applied to an existing installation.

To facilitate an understanding of the invention and its environment, FIG. 1 illustrates an inside wall 20 of a home or office. The wall is formed with a standard double-hung window combination consisting of a heading 22, a left jamb 24, a right jamb 26, a sill 28, a top sash 30 and a bottom sash 32. An air conditioning unit generally designated 34, with a casing 36, is installed in the usual way with its bottom surface 38 suitably supported and sealed on sill 28.

The air conditioning unit mounting includes left and right filler panels 40, 40 which may be of any suitable material with means for sealing them against the casing side surfaces 42, 42 and the window jambs 24, 26. The filler panels may comprise accordion-pleated sealant curtains which are expansible to fit a range of window widths. Such a pleated curtain may be formed of polyolefin plastic or some equivalent material in order to provide resilient hinge portions as disclosed for example in U.S. Pat. No. 3,587,441 to Normal W. Woods, U.S. Pat. No. 3,111,076 to W. C. Martin , Jr. et al, and U.S. Pat. No. 3,911,803 to Carlito M. Kong et al.

The embodiment of the supplemental ventilating device shown in FIGS. 1 through 5 is generally designated 44 and is installed between the lower rail 46 of the bottom sash 32 and the top surface 48 of the air conditioner unit casing. The ventilating device 44 comprises frame means generally designated 48, screen means generally designated 50 and door means generally designated 52, all of which are mutually extendible and retractible to fit the window width involved. These individual means will now be described in detail.

The frame means 48 includes a fixed central portion 54 and two side portions 56, 56. As indicated by the arrows in FIG. 3, the side portions 56 are telescopically extendible and retractible relative to the central portion 54 to accommodate a range of different window widths.

Figure 3:
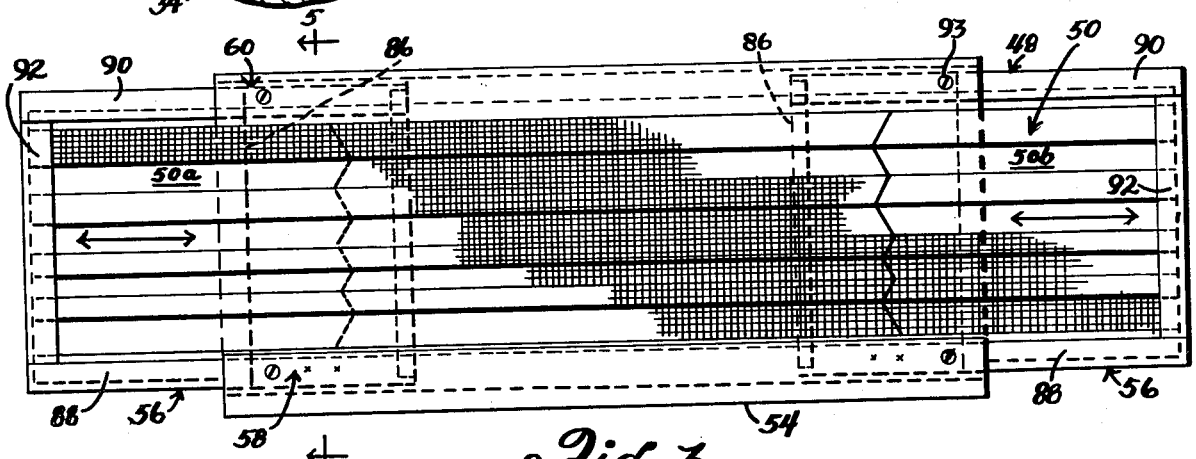
FIG. 3 is an enlarged elevational view of an extendible frame and screen used in the embodiment shown in FIG. 1, and which in use is covered by the closed flow-control door shown in FIG. 4.
Figure 5:
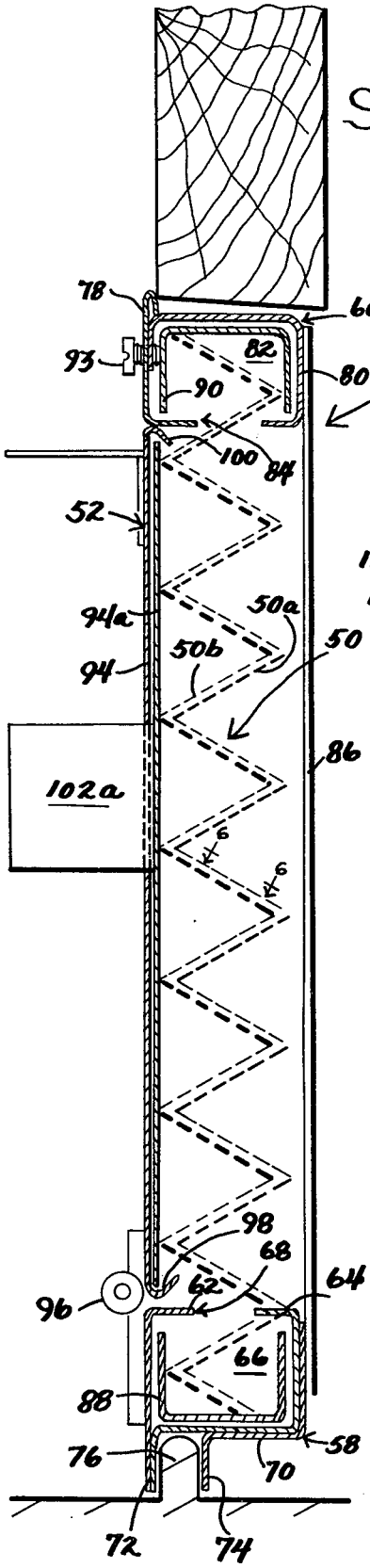
FIG. 5 is an enlarged, vertical cross-sectional view of FIGS. 1, 3 and 4 taken in each case along line 5—5.

The central portion 54 consists of lower and upper channels 58 and 60 having cross sections best shown in FIG. 5. The lower channel has two strips 62 and 64 formed and connected as by spot welding to provide a rectangular cross-section space 66 with an upwardly facing slit 68. A third strip 70 is spot welded to the outside of strip 64. The combined bottom edge portions of strips 62 and 64 form a downward lip 72, the bottom edge portion of strip 70 forms a downward lip 74. These lips are spaced apart to provide a downwardly facing groove for receiving an upstanding ridge or angle member 76 commonly provided on air conditioner unit casings. The upper channel 60 comprises two strips 78 and 80 formed and connected as by welding to provide a rectangular cross-section space 82 having a downwardly facing slit 84. Channels 58 and 60 are rigidly spaced apart and tied together as a unit by a pair of vertical straps 86 as shown in FIGS. 3 and 5.

Figure 6:
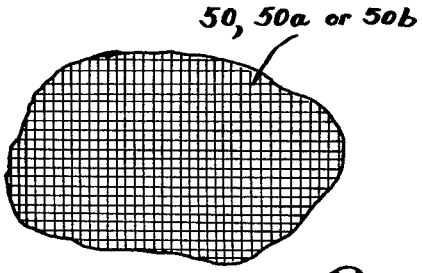
FIG. 6 is a fragmentary enlarged view of a screen which may be used with this invention as seen, for example, along lines 6—6 of FIGS. 5 and 13.
Figure 7:
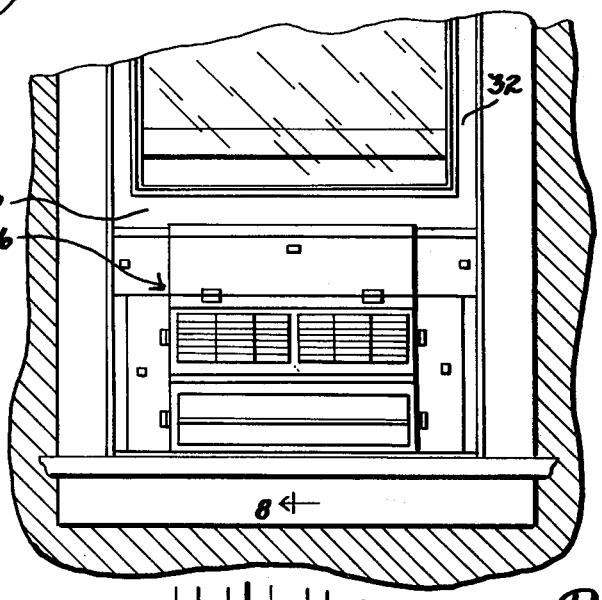
FIG. 7 is a fragmentary elevational view, similar to FIG. 1, of a ventilating device illustrating an alternate embodiment of the invention.
Figure 8:
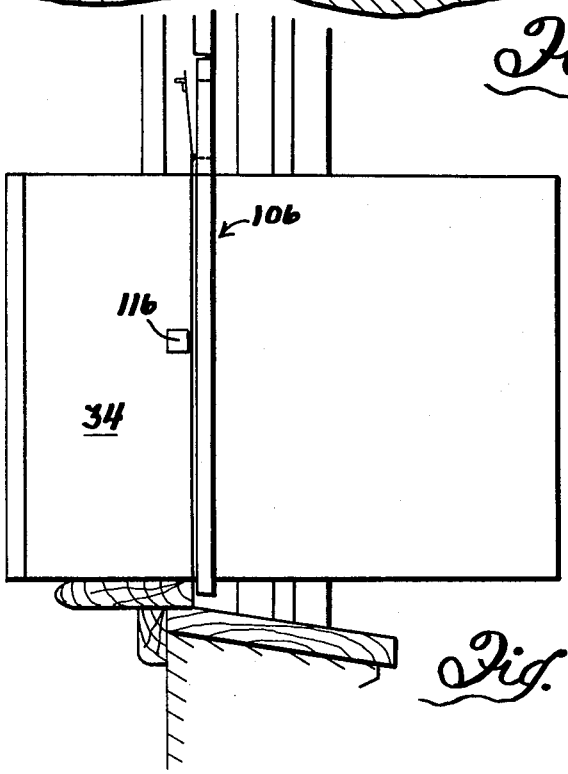
FIG. 8 is a side elevational view, partly in section, taken along line 8—8 of FIG. 7.

Each frame side portion 56 is C-shaped (FIG. 3) and comprises lower and upper U-cross-section channel members 88 and 90 interconnected by a vertical channel member 92. Channel sections 88 and 90 are telescopically slidable in the spaces 66 and 82 of central channel members 58 and 60 as shown in FIG. 5. Optionally, the three channel members 88, 90 and 92 may be formed integrally from a single channel section, or may be welded, soldered or brazed from three separate pieces of U-section channel stock. As best shown in FIG. 5, channels 88 and 90 are loosely slidably assembled within channels 58 and 60 and may be held in any desired extended position by tightening set screws 93. The screen means 50 may take any desired form enabling it to expand and contract horizontally as the frame side portions 56 are moved in and out of the central portion 54. Here, the screen means is illustrated as any metallic or plastic screen with crossing, wire-like elements with apertures therebetween as shown in FIG. 6. It will preferably be pleated along horizontal lines to provide an accordion-like contour. Two such screen portions **50*a* and 50*b* are connected respectively to the side frame portions 56, 56. Movement of one or both of these side frame portions cause relative movement of the screen portions 50*a* and 50*b*** to vary the extent of overlap between them.

Referring to FIG. 5, the screen sections **50*a* and 50*b* will extend through slit 84 at the top and through slit 68 at the bottom into channel members 80 and 58 and their respective extension members 90 and 88**.

The pleated accordion shape of the screen portions is clearly shown in FIG. 5. This shape, combined with the inherent resilience and elasticity of the metal or plastic materials cause the screen portions to cling together in sufficiently close proximity to effectively exclude insects and other pests in substantially the same manner as a one-piece screen, yet will enable the overall screen width to be varied as required to match the width between jambs of the window.

Figure 4:
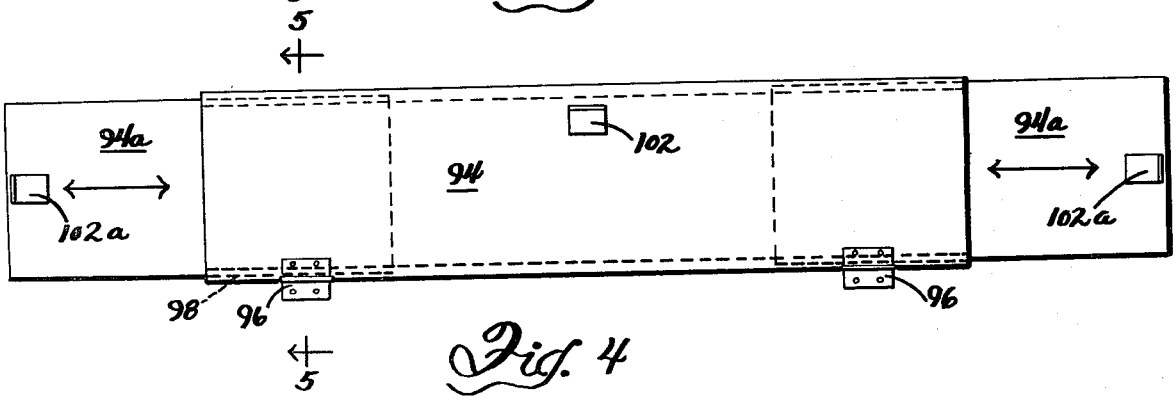
FIG. 4 is a fragmentary, enlarged view of the flow-control door shown in FIG. 1.

The extendible door means 52 comprises a main or central door member 94 pivotally mounted on the lower channel 58 by a pair of hinges 96, 96 which may be spot welded or screwed to the lower channel 58 at the positions marked "x" in FIG. 3. Each central door member 94 is crimped outwardly, along bottom and top edges to provide narrow flanges 98 and 100 as shown in FIGS. 4 and 5. Each door means 52 has two opposite auxiliary door portions **94*a*, 94*a*, each consisting of a flat plate horizontally slidable between the flanges 98 and 100. A small handle 102 formed of bent sheet metal is fastened to the central door portion. Similar handles 102*a* are fastened to the auxiliary side door portions 94*a*. As shown in FIGS. 3 and 4, which are drawn to the same scale, it will be apparent that the auxiliary side door portions 94*a* are adjustable to be coextensive with corresponding portions of screens 50*a* and 50*b*** at all adjusted widths of the device.

In operation, the supplemental ventilating device 44 has a number of operative mode positions varying from fully closed as shown in FIG. 1 to fully opened, with intermediate modes for lesser than full degrees of ventilation being obtainable by opening one or both of the auxiliary door side end portions **94*a* in varying amounts. Thus, when the air conditioning unit is operating to cool the room, or in winter weather, when no outside ventilation is wanted, the central door portion will be swung upwardly and outwardly to its fully closed position, and the auxiliary door side end extensions 94*a* will be moved fully outwardly to their closed positions, all of which are shown in solid lines in FIGS. 1, 4 and 5. For a relatively small ventilation requirement, one or both of the auxiliary door extensions 94*a* may be opened, as shown in broken lines at 104 in FIG. 1. For full ventilation, the central door member 94 with its auxiliary side extensions 94*a* will be pulled downwardly and inwardly to fully opened positions. This will allow ventilating air to flow through the entire screen 50** and ventilate the room without the necessity of running the air conditioning fan motor.

Figure 9:
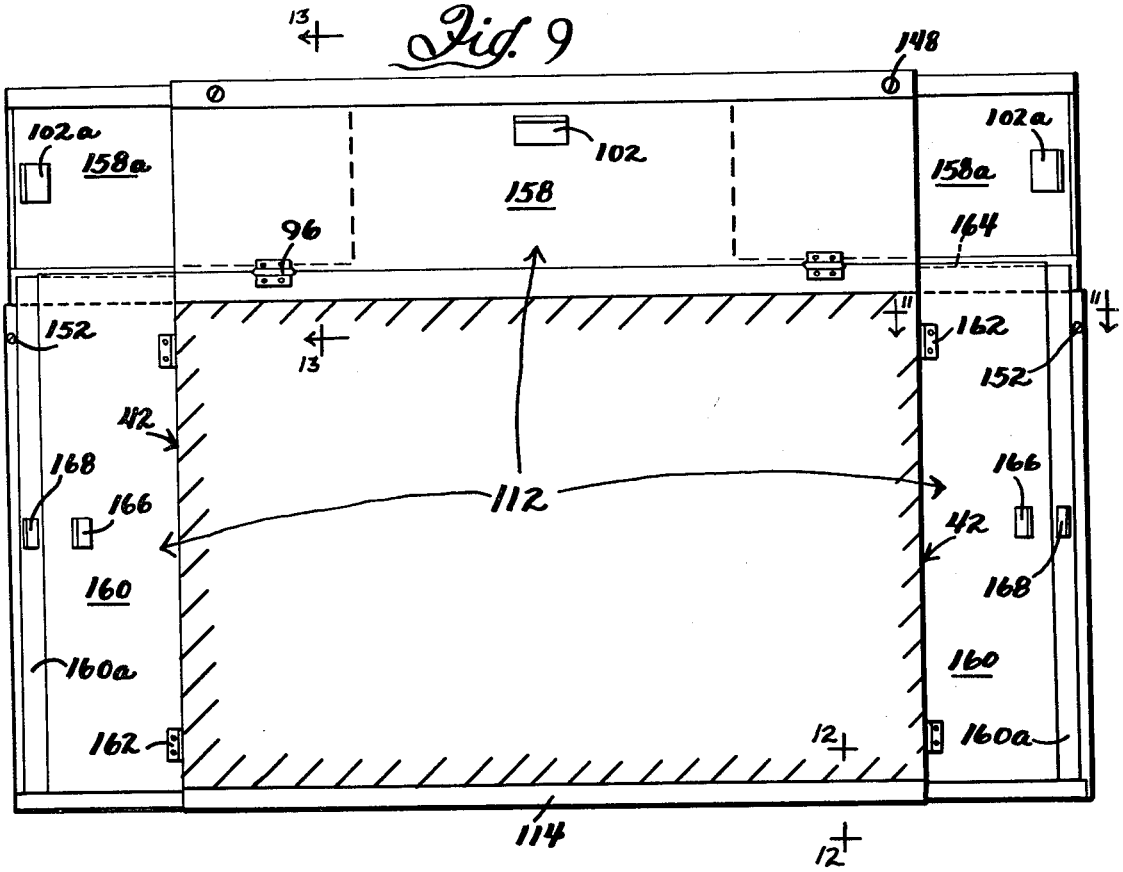
FIG. 9 is a fragmentary enlarged view of FIG. 7 showing the device in fully closed position.
Figure 10:
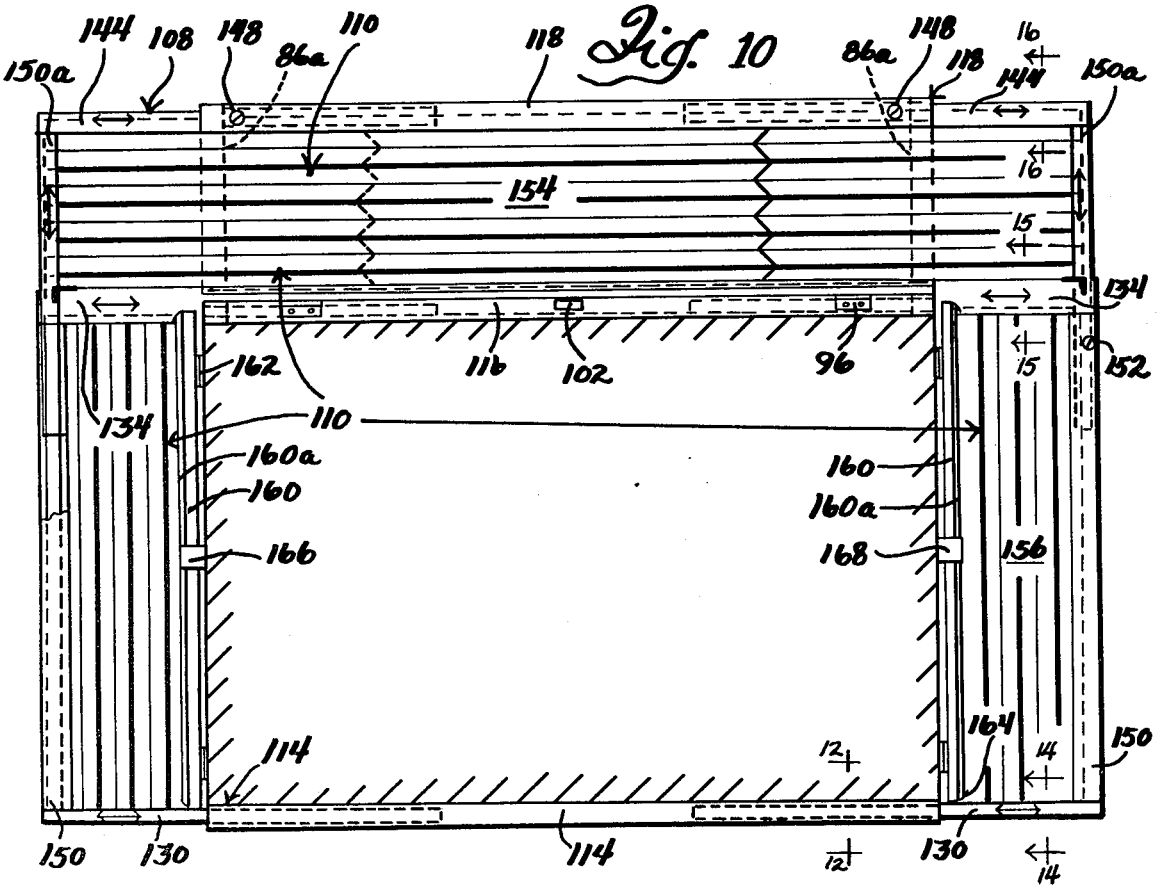
FIG. 10 is similar to FIG. 9 showing the device in fully opened position.

The alternate embodiment of the invention shown in FIGS. 7 through 16 is generally designated 106. It will now be described in a window similar to that shown in FIG. 1. As shown in FIGS. 9 and 10, it comprises frame means 108, screen means 110, and door means 112, all of these being extendible and retractible to fit the window space available.

The extendible frame means includes first and second horizontal channel members 114 and 116 across the bottom and top surfaces of the air conditioner casing, and a third channel member 118 spaced above the second member and extending along the bottom rail 120 of the bottom window sash 122. As shown in FIG. 12, the first channel member 114 comprises a closed rectangular cross-section tube fabricated from a flat strip 124 and a flanged, U-section channel member 126. These are brazed or welded together along the flanges and provide a rectangular cross-section space 128 within which a U-section extension channel member 130 is telescopically slidable and extendible at each end. As shown in FIG. 13, the second channel member 116 is a square cross-section tube with an upwardly facing slit 132. A double channel extension member 134 is telescopically slidable within channel member 116. It is fabricated from a vertical strip 136 and a Z-shaped strip 138 suitably fastened together along their upper edge portions by welding or brazing. The Z-shaped strip defines downwardly and upwardly facing spaces 140 and 142 within channel 116 for engaging, respectively, two side screens 156 (to be described) and the upper screen 50. As also shown in FIG. 13, the third channel member 118 may be identical with channel 60 already described in connection with FIG. 5, so that description will not be repeated. It has a lower slit **84*a*. A downwardly open, U-cross-section extension member 144 is slidably, telescopically engaged within a space 146 at each end of channel 118. Channels 116 and 118 will be tied together and held a fixed distance apart by two tie straps 86a which are similar to straps 86** previously described.

Thus as best shown in FIG. 10, first, second, and third extension channel members 130, 134 and 144 extend respectively from opposite ends of first, second and third channel members 114, 116 and 118. They are held in a selected adjusted position by set screws 148.

A vertical channel member 150 interconnects the outer ends of each corresponding pair of first and second channel member extensions 130 and 134. As shown in FIG. 11, the vertical channel member 150 is an angle member with front and side flanges and minor crimped-over flanges 151 slidably retaining a vertical extension member 150a at each side of the air conditioning unit. Each vertical extension member 150a is connected as by welding or brazing to the outer end of the corresponding horizontal extension member 144.

Thus, the frame means generally designated 108 is variable in width to accommodate windows of different widths by moving the horizontal extension members 130, 134, 144 simultaneously in their respective channel members 114, 116 and 118. Further, the upper channel member 118, its horizontal extensions 144, 144, is adjustable up and down by moving vertical extensions 150a up and down in their respective vertical channel members 150. They will be locked in place by means of set screws 152.

As best shown in FIG. 10, the screen means 110 comprises a top screen 154 and two side screens 156, 156. The top screen 154, as shown, is identical to the two-piece screen 50 described in connection with the FIG. 1–5 embodiment, consisting of separate screen portions 50a and 50b, and that description will not be repeated. Each side screen 156 may be of the same accordion-pleated material, either metal or plastic, with the pleats extending vertically to enable horizontal expansion and contraction. Each side screen 156 is contained within a rectangular space of varying width defined by casing side wall 42, vertical channel member 150, first channel extension member 130,and second channel extension member 134. The outer vertical edge of each screen 156 is suitably retained as by means of adhesive or clamps (not shown) in vertical channel member 150. The bottom edge portion of each side screen 156 is suppoted within the space 128 in a respective one of the U-section extension channel members 130 as best shown in FIG. 14. The upper edge portion of each side screen 156 is supported within lower space 140 in a respective one of the extension members 134 as best shown in FIG. 15. Referring to FIG. 11, the natural springiness and tendency for the screen to expand will normally hold it snugly between the casing wall 42 on the one hand and the vertical channel member 150 and its respective extension 150a on the other hand, even in the absence of any adhesive or clamps special holding means for the screen.

Referring to FIG. 13, the accordion-pleated screen segments 50a and 50b will extend at the top, through slit 84a into space 146 within channel member 118 and its respective extension member 144. At the bottom, the spring segments will extend through the slit 132 into the space 142 within the channel member 116 and its respective extension member 134.

Thus, the frame means 108 of the FIG. 7–16 embodiment is variable in width to accommodate windows of different width by moving the horizontal channel extension members 130, 134, 144 simultaneously in their respective channel members 114, 116, 118. Further, the third (upper ) channel member 118 (with its horizontal extension 144) is adjustable up and down by moving vertical extensions 150a up and down in their respective vertical channel members 150.

For the sake of uniformity and limiting stocking requirements, the screens 50, 154 and 156 may be of the same accordion-pleated material, either metal or plastic. As shown, the pleats extend horizontally in top screens 50 and 154 and vertically in side screens 156.

The extendible door means generally designated 112 comprises a top, central door 158 (with two auxiliary door extensions 158a ) and two side doors 160 (each with an auxiliary door extension 160a ). The top, central door 158 and auxiliary door portions 158a are identical to the central door portion 94 and auxiliary door portions 94a already described in connection with the FIG. 1–5 embodiment. That description will not be repeated. Each side door 160, with its extension 160a provides a two-piece, horizontally expansible and contractible construction, coextensive with the respective side screen 156. One door 160 is pivotally mounted on each casing side wall 42 by hinges 162. Along its upper and lower margins, crimped flanges 164, 164 are provided serving as a guide for the corresponding slidable auxiliary door extension 160a Handles 166 168 provide means for manipulating the side doors and its extensions. All or some of the doors may be made of opaque, or transparent materials are desired.

In most cases, the ventilating device and air conditioning unit will be centered in a window. However, in case of a narrow window, or for some other reason, an offcenter arrangement may be appropriate. For this purpose, one of the side doors 160 and its extension 160a may be folded back against the air conditioning unit casing, or removed, in which case the ventilating device will function satisfactorily with the top door and screen and the other side door and screen.

In operation, the top screen 154 and top door 158 in the FIG. 7–16 embodiment functions in exactly the same way as the top screen and door described in the FIG. 1–5 embodiment. The side doors 160 and their extensions 160a provide additional ventilation, allowing much greater flow of air when they are all open. When no ventilation is wanted, all doors are closed as shown in FIG. 9. When maximum ventilation is needed, all doors are opened as shown in FIG. 10. And when some intermediate degree of ventilation is needed, the doors and their extensions may be adjusted in various combinations and degrees to provide the desired ventilating effect.

The embodiments described to illustrate the present invention have been necessarily specific for purposes of illustration. Alterations, extensions and modifications would be apparent to those skilled in the art.

The embodiments of the invention in which an exclusive property or privilege is claimed are defined as follows:

1. A supplemental ventilating device for an air conditioning window unit having a casing supported on a sill in a window opening beneath a sash, said ventilating device comprising:

a top rectangular frame with a height adapted to span the distance between the casing and the window sash and a width adapted to span the distance between the left and right jambs of the window in which the casing is located;

a top screen within said frame; and a top door coextensive with said screen, said door including a main door portion which is hinged to said frame for movement between a fully opened position enabling flow of ventilating air through said screen externally of said casing, and a fully closed position blocking such flow of air, said door further including at least one auxiliary door portion which is movable relative to the main door portion to uncover a corresponding portion of the screen when the main door portion is closed thereby enabling flow of ventilating air through said portion of the screen at a rate determined by the position of said auxiliary door portion.

2. A supplemental ventilating device according to claim 1 in which said auxiliary door portion is slidably mounted with respect to the main door portion.

3. A supplemental ventilating device according to claim 1 in which the width of the frame, screen and door are adjustable to accommodate different window widths.

4. A supplemental ventilating device according to claim 1 in which:

the frame comprises a central frame portion and a pair of telescopically extendible and retractible auxiliary frame portions at opposite sides to adjust the width of the frame for different window widths;

said screen being expandible and contractible in width and the end portions of said screen being connected respectively to said auxiliary frame portions to vary the width of the screen with the width of the frame;

said door comprising a central door portion and a pair of telescopically extendible and retractible auxiliary door portions at opposite sides to vary the width of the door with the width of the frame; and means for moving each of said auxiliary door portions when the door is in closed position to enable flow of ventilating air through the side end portions of the screen at a rate determined by the positions of said auxiliary door portions.

5. A supplemental ventilating device according to claim 4 in which the end portions of the screen comprise two separate, overlapping screen portions which are movable relative to one another to vary their overlapping relation in response to movement of the auxiliary frame portions to vary the width of the frame.

6. A supplemental ventilating device according to claim 5 in which said two separate overlapping screen portions are pleated horizontally to provide interfitting accordion-like contours.

7. A supplemental ventilating device according to claim 1 in which:

said ventilating device includes, in addition to said top screen, frame and door above said casing, a side frame on each side of the casing, each side frame having a width extending between the side of the casing and a window jamb, and a height extending between the window sill and said top frame;

a side screen within each said side frame;

a side door coextensive with each said side screen and mounted on the corresponding side frame for movement between a fully opened position enabling flow of ventilating air through the side screen, and a closed position preventing such flow of ventilating air.

8. A supplemental ventilating device according to claim 7 including means for hingedly mounting each side door on said casing.

9. A supplemental ventilating device according to claim 7 in which said top frame is expansible in width and said top screen is expansible in width and comprises two, separate overlapping screen portions which are simultaneously expansible with said top frame.

10. A supplemental ventilating device according to claim 9 in which said two overlapping screen portions are pleated horizontally to provide interfitting, accordion-like contours.

11. A supplemental ventilating device according to claim 7 in which the widths of each side frame and side screen are adjustable to accommodate different window widths.

12. A supplemental ventilating device according to claim 11 in which each side door comprises a main door portion with means for hingedly mounting it to the casing, and an auxiliary door portion telescopically extendible and retractible relative to the main door portion.

13. A supplemental ventilating device for an air conditioning window unit having a casing supported on a window sill and spaced below a window sash between window jambs, said ventilating device comprising:

expansible frame means, expansible screen means, and expansible door means controlling air flow through said screen means;

said expansible frame means including;

first and second parallel, horizontal channel members adapted to extend across the bottom and top surfaces respectively of said casing, a third horizontal channel member, parallel to said first and second channel members, spaced above said second channel member and adapted to extend along the bottom of the window sash, first, second and third horizontal extension members extending respectively from opposite ends of said first, second and third channel members and being slidably extendible therefrom to vary the width of said frame means, a vertical channel member at each side of the frame means interconnecting the outer ends of said first and second horizontal extension members, and a vertical extension member at each side of the frame means connected to the outer end of the third channel member and being slidably extendible upwardly from the corresponding vertical channel member to adjust the height of said third horizontal channel member;

said expansible screen means includinga side screen on each side of the frame means bounded at the inside and outside respectively by the corresponding side wall of the casing and by the vertical channel member, and bounded at the bottom and top respectively by the corresponding horizontal extension members of the first and second horizontal channel members, each said side screen being expansible and contractible in a horizontal direction to accommodate varying widths of said frame means, and a top screen at the top of the frame means bounded on opposite sides by said vertical extension members, and bounded at the bottom and top respectively by the second and third horizontal channel members and their extension members, said top screen being expansible in both horizontal and vertical directions to accommodate varying width and height adjustments of said frame means; and said expansible door means includinga side door on each side of the frame means coextensive with the corresponding side screen, each said side door being expansible and contractible in a horizontal direction to accommodate varying widths of said side screen, each said side door having means for hingedly connecting it to the side of said casing to control flow of ventilating air through the corresponding side screen, and a top door at the top of the frame means coextensive with the top screen and being expansible and contractible in at least a horizontal direction to accommodate varying widths of said top screen, said top door being hinged to said frame means to control flow of ventilating air through the top screen.

* * * * *